United States Patent [19]

Guenzel et al.

[11] 4,199,169

[45] Apr. 22, 1980

[54] ADJUSTING MECHANISM FOR A SKI

[76] Inventors: Ernst W. Guenzel, Waldperlacherstrasse 12; Otto Kabilka, Brockesstrasse 18, both of 8000 Muenchen 83; Dieter Lissewski, Siegertsbrunner Strasse 14, 8011 Hohenbrunn, all of Fed. Rep. of Germany

[21] Appl. No.: 932,013

[22] Filed: Aug. 8, 1978

[30] Foreign Application Priority Data

Aug. 16, 1977 [DE] Fed. Rep. of Germany ..... 2736908

[51] Int. Cl.[2] ..... A63C 5/07

[52] U.S. Cl. ..... 280/602

[58] Field of Search ..... 280/602, 601, 609, 610

[56] References Cited

U.S. PATENT DOCUMENTS

| | | | |
|---|---|---|---|
| 3,318,609 | 5/1967 | Ross | 280/602 |
| 3,398,968 | 8/1968 | Mutzhas | 280/602 |
| 3,747,947 | 7/1973 | Guenzel | 280/602 |

*Primary Examiner*—Robert R. Song

*Attorney, Agent, or Firm*—Blanchard, Flynn, Thiel, Boutell & Tanis

[57] ABSTRACT

An adjusting device for adjusting the position of weights mounted for longitudinal movement within a ski. A drum is rotatably supported within a housing on the ski and has flat belts wound thereon, one belt extending to a weight supported for movement between the binding area on the ski and the tail of the ski and the other belt extending to a weight mounted for movement between the tip of the ski and the binding area. A manually engageable setting member is provided for rotating the drum to control the amount of flat belt wound onto the drum. A hollow member is provided in the ski to simplify the manufacturing process. The hollow member has the flat belts and the weights mounted therein for movement with respect thereto along the longitudinal axis of the ski. Printed indicia can be provided on either the flat belts or on the ski to indicate the relative location of the weights with respect to the tip and the tail of the ski.

26 Claims, 18 Drawing Figures

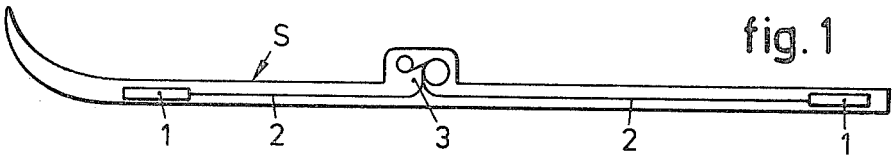
fig. 1
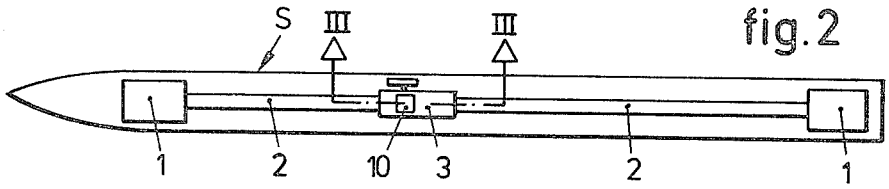
fig. 2
fig. 3
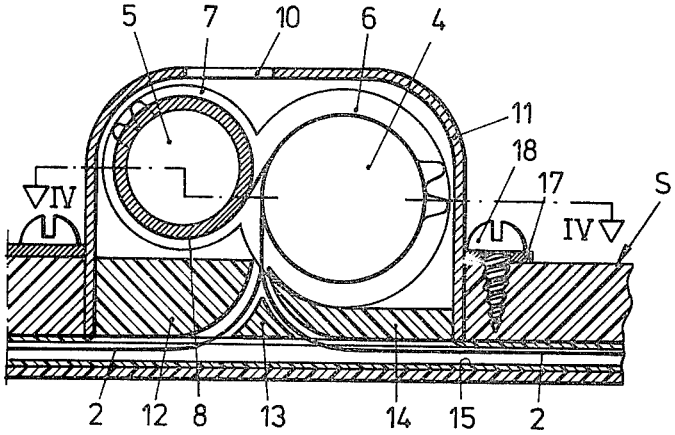
fig. 5
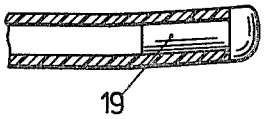
fig. 4
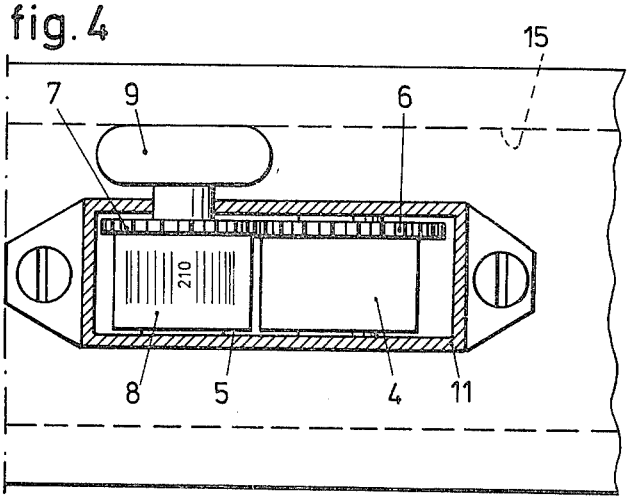
fig. 6
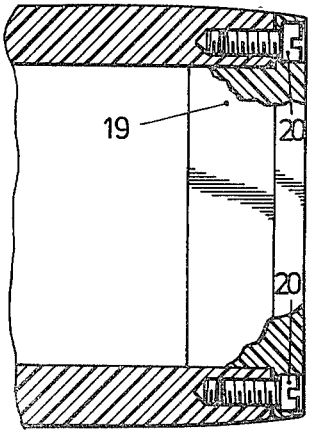

fig. 7a
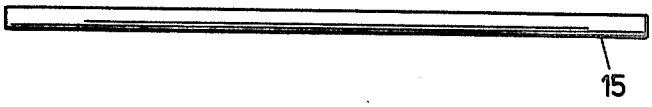
fig.7b
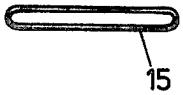
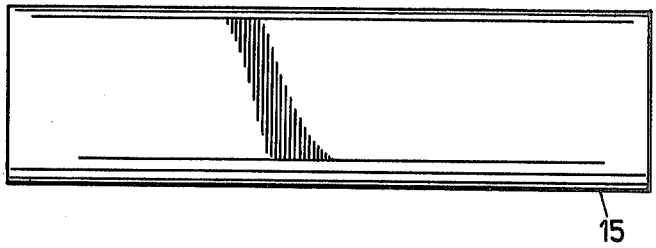
fig.7c
fig. 8
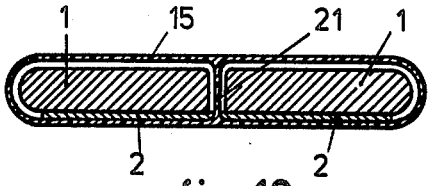
fig.9
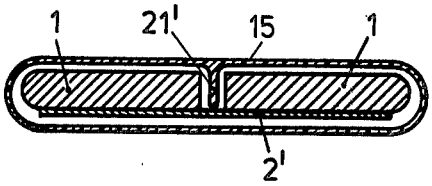
fig. 10
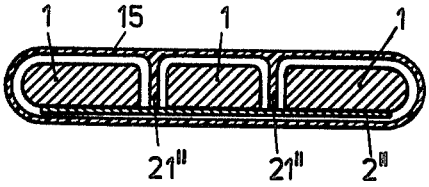
fig. 11
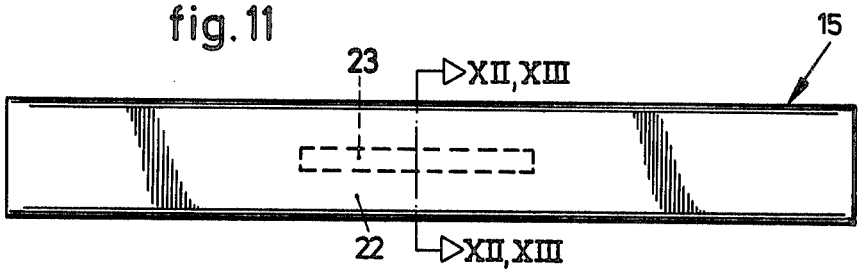
fig.12
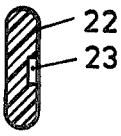
fig.13
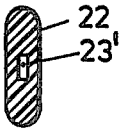

ADJUSTING MECHANISM FOR A SKI

FIELD OF THE INVENTION

The invention relates to an adjusting mechanism for a ski, with which one or several mass members are movable within the ski member along its longitudinal axis and can be secured within the adjusting range at any desired location by utilizing an adjustable set wheel and belts or connecting elements which are connected to the mass members, which belts or connecting elements are moved by the set wheel.

BACKGROUND OF THE INVENTION

With the aid of such an adjusting mechanism which is described in U.S. Pat. No. 3,747,947, the mass inertia of the ski is changed about a vertical axis which extends approximately in the binding area vertically through the surface of the ski, to thus give for example to a so-called compact ski of relatively short length the traveling characteristis of a long ski selectively when with the aid of the adjusting mechanism, the two mass members are shifted toward the tip or tail of the ski.

The purpose of the invention is to construct such an adjusting mechanism to provide a construction which is as simple as possible and thus inexpensive, the two mass members of which mechanism can be moved within the ski member to a desired location along the longitudinal axis of the ski and can be secured thereat, without creating the risk of a jamming of the mass members in the ski member due to the occurrence of twistings and bendings.

In an adjusting mechanism of the above-mentioned type this purpose is attained according to the invention by the belts or connecting elements comprising at least two flat belts which can be stressed for pull and pressure, the free ends of which flat belts can be connected to each one of the mass members, and by at least one first drum being connected to the set wheel, onto the circumference and from the circumference of which drum the flat belts can be wound and unwound.

By using flat belts as connecting elements, the two mass members can be pulled and also pushed into the respective desired position, because such flat belts can be stressed for both pull and also pressure. To adjust the mass members, the flat belts are wound onto and removed from a drum, and for each flat belt there can be provided a separate or, however, for both flat belts a common drum. If both flat belts are wound onto one single common drum according to a preferred embodiment, then they lie in every winding position one on top of the other and can during their unwinding from the drum, for example with the aid of suitably formed sliding guides, be moved one time in direction toward the tip of the ski and one time in direction toward the tail of the ski. These flat belts have thereby the same elastic characteristics as for example a flat belt which is used in a tape measure roll, which is advantageously manufactured of steel and is slightly arced in its transverse direction so that it has a greater stiffness in its longitudinal direction.

According to various embodiments and developments of the invention, it is possible to arrange in place of the single drum also two drums side-by-side, and in every case one drum is associated with a mass member and a flat belt. If both drums are provided with separate set wheels, then it is also possible to adjust the two mass members independently of one another in the respectively desired manner. On the other hand, it is possible to move with the two drums each of the two flat belts and two mass members, so that the adjusting mechanism has all together four mass members, which for example may be advisable when the mass members are guided in two guideways which extend parallel to one another, so that in the central longitudinal axis of the ski the guideways can be constructed through-going from top to bottom to create a greater rigidity than a ski which is provided with only a relatively wide guideway for the mass members.

According to a further development of the invention, the guideway for the mass members is formed by a hollow member made of fiber-reinforced plastic, which is to be manufactured by itself and independently from the actual ski member. Such a very flat and thin-walled elongated hollow member permits a very secure guiding of the flat belts, so that these can become only slightly wavy during a pressure stress for moving of the mass members, which can influence neither their movement nor the movement of the mass members. The mass members themselves are also guided in the flat hollow member so that it forms with same and the flat belts one structural unit. The one or several drums for moving the flat belts are to be arranged in a housing, which is to be connected through a moistureproof connection to the ski member or the hollow member, if the hollow member was earlier built into the ski member during the manufacture of the ski.

According to an important further development of the invention, a second drum is provided, onto which or from which a third flat belt can be wound and removed, and the rotary movements of both drums are coupled. This third flat belt is during the winding and unwinding of the two first flat belts also wound above these onto the first drum, which causes the wound-up first two flat belts to be pressed firmly against the circumference of the first drum, also in the case of several winding-up layers. Even during an unwinding of the two first flat belts from the first drum, a sudden unwinding of layers of the two first flat belts cannot occur, which could lead to a blocking of the adjusting mechanism.

BRIEF DESCRIPTION OF THE DRAWINGS

The invention will be described more in detail with reference to exemplary embodiments which are illustrated in the drawings, in which:

FIGS. 1 and 2 are schematic side and top views of the new adjusting mechanism in connection with a ski;

FIG. 3 is a cross-sectional view of the housing which contains the drums of the adjusting mechanism;

FIG. 4 is a top cross-sectional view of the housing shown in FIG. 3;

FIGS. 5 and 6 are side and top cross-sectional views of the rear portion of the ski;

FIGS. 7A, 7B and 7C are side, top and front views, respectively, of a flat hollow member for guiding the flat belts and mass members;

FIGS. 8, 9 and 10 are schematic cross-sectional views of various embodiments of the hollow member;

FIG. 11 is a schematic top view of a further embodiment of the hollow member;

FIGS. 12 and 13 illustrate two different embodiments of a center portion of the hollow member shown in FIG. 11;

DETAILED DESCRIPTION

Figure 14:
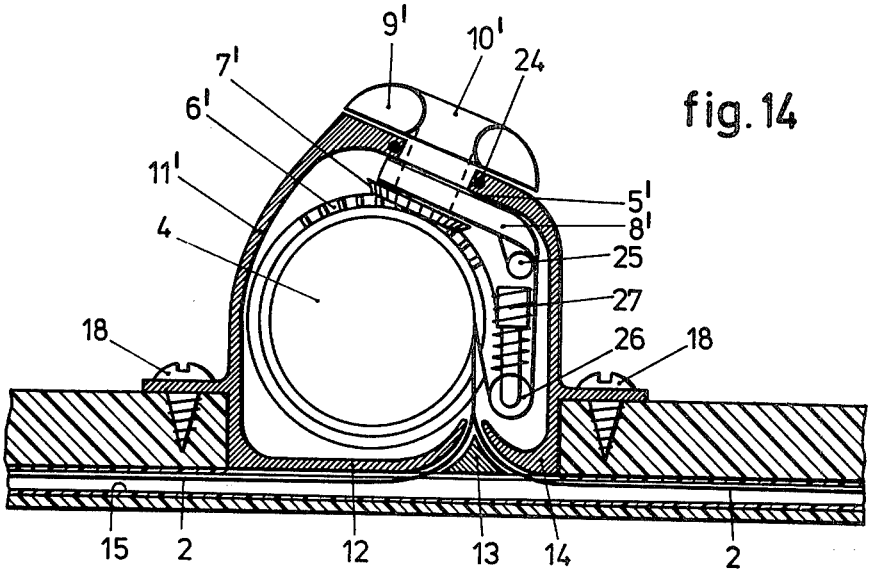
FIGS. 14 and 15 are a cross-sectional and top view of a different embodiment of the adjusting mechanism.

As can be recognized from FIGS. 1 and 2, within the ski member S of a ski there are arranged mass members 1, which are steplessly adjusted and fixedly locatable between an outer extreme position adjacent the tip or tail of the ski to an inner extreme position adjacent the binding. For this purpose, the ski has an adjusting mechanism 3, which is illustrated more in detail in FIGS. 3 and 4. The adjusting mechanism 3 has a housing 11 with a window 10 therein, so that at any time one can determine the present adjustment of the mass members 1 with the aid of a suitable indicator.

As one will recognize from FIGS. 3 and 4, flat belts 2 are guided in a hollow member 15 which extends coextensively with the longitudinal edges of the ski, which flat belts extend from the actual adjusting mechanism 3 to the mass members 1. Both the flat belt 2 which comes from the tip and also the one which comes from the tail of the ski and wound onto a first drum 4, and in every wound position the two flat belts 2 lie one on top of the other. In addition a second drum 5 is provided, onto which a further flat belt 8 is wound. The flat belt 8 when being removed from the second drum 5, is also wound onto the first drum 4, and in every case it comes to lie above or on top of the two first flat belts. The two drums 4 and 5 are rotatably coupled, for example, through spur gears 6 and 7 meshingly engaged with one another. The two flat belts which are loaded for pressure during unwinding are supported against the further flat belt. As can be recognized from FIG. 3, the diameter of the gear 7 and also of the drum 5 is less than the diameter of the gear 6 and the diameter of the drum 4, from which results a transmission ratio between the gear 7 and the gear 6. A graduated indicia, as for example in a common tape measure, is preferably mounted on the third flat belt 8 which is wound onto the second drum 5, the graduations of which can be read through the window 10 in a lid of the housing 11 which encloses the two drums and the gears. The indicia provides a measure for the respective position of the mass members. The lid of the housing 11 is fastened and sealingly closed off on the ski member with the aid of a flange 17 and screws 18. Seals can be used in a conventional manner.

As will be recognized from FIG. 4, the gear 7 or rather the second drum 5 is connected to a manually adjustable set wheel 9. The controlling forces which must be produced by the set wheel 9 are therefore transmitted accordingly through the transmission ratio between the gears 7 and 6 and are, therefore, relatively small.

As will be recognized from FIG. 3, suitably formed guide pieces 12, 13 and 14 are provided below the drums 4 and 5, in order to guide the flat belts 2 during their winding or unwinding on the drum 4 into and out of the hollow member 15 so that no deforming of the flat belts will occur. The flat belts are in a conventional manner preferably made of steel and are slightly arced in their transverse direction, which lends them a greater rigidity and a higher resistance to deformation. However, during winding of the flat belts onto the drums, this transverse arc is immediately removed so that in the case of very thin flat belts only relatively thin winding layers result on the drums.

Even though this is not illustrated in the drawings, instead of the single first drum 4 it is also possible to provide two first drums side-by-side on a common axis or, and on the other hand, one behind the other. Each of the two first drums are associated only with one mass member 1 and only one flat belt. A separate individual adjustment of both the front and also the rear mass member is therefore possible. Every first drum 4 has thereby associated with it a second drum 5 with a third flat belt and a set wheel 9 which is connected to the drum.

On the other hand, it is however also possible to provide four flat belts 2 and four mass members 1. The latter are each formed by division of the mass members shown in FIGS. 1 and 2. Two flat belts are rolled up in this case again onto each drum 4, and the mass members 1 are guided in hollow members 15 which extend parallel to one another. Such an embodiment makes sense in order to increase the stiffness of the ski member by providing the hollow member 15 for example with a crossbar.

The adjusting mechanism 3 must not, as shown in FIGS. 1 and 2, be arranged immediately before the binding, but rather it can be arranged at any desired location along the longitudinal axis of the ski. Thus, the adjusting mechanism 3 could for example be arranged between the tip of the ski and the binding area to simultaneously make crossing of the skis more difficult in a conventional manner. In this case, the flat belts 2 for the front and rear mass member would then not extend from the adjusting mechanism 3 in different directions, but would extend rather in the same directions.

As will be discussed hereinbelow in connection with FIGS. 7A to 13, the hollow member 15 consists for guiding of the flat belts 2 and also of the mass members 1, of one extremely flat, extended hollow profile of thin-wall dimensions, which is manufactured by itself for example of a fiber-reinforced plastic. During the manufacture of the ski member, the hollow member 15 is formed as a finished structural element into the ski member. The hollow member 15 extends thereby to the rear edge of the ski, so that its opening is preferably accessible from the rear edge of the ski. This construction is illustrated schematically in FIGS. 5 and 6, and the entire ski is closed off by a cap piece 19. The cap piece simultaneously closes off the hollow member 15 which is open toward the rear.

The cap piece 19 can for example be secured with the aid of screws 20, so that the hollow member 15 is sealingly closed off also at this point to provide a moisture-proof enclosure.

During installation, service or also a possible repair of the adjusting mechanism, it is possible after removal of the cap piece 19 to pull the masses 1 and also the flat belts out of the hollow member 15. During installation, the mass members 1 and the flat belts 2 are moved from the rear one after the other into the hollow member 15, then the flat belts 2 are pulled out upwardly at an opening approximately in the center part of the hollow member 15, fastened on the drum 4 and subsequently the lid of the housing 11 is sealingly secured on the ski member or on the hollow member. Installation, service and repair of the new adjusting mechanism are therefore also extremely simple.

FIGS. 7A, 7B and 7C illustrate schematically the side view, the top view and the front view, respectively, of an embodiment of a hollow member. The hollow member is a very flat, relatively wide and elongated hollow member having very thin-wall dimensions. The ski S can also be manufactured hollow, without utilizing the hollow member of glass fiber. For this a core can be used, which after the ski is finished can be pulled out.

The hollow member 15 can also have a crossbar, which is constructed through-going in FIG. 8 and not throughgoing in FIG. 9. As will be recognized from FIG. 8, two parallel flat belts 2 slide in the hollow member 15, on which each a mass member 1 is arranged. As is illustrated in FIG. 9, a through-going flat belt 2' can also be used, on which the mass member 1 is arranged in split form. Due to the through-going bar 21, the hollow member shown in FIG. 8 has two separate hollow member parts, which substantially increases the stiffness of the hollow member and thus also of the ski which has the hollow member. This bar 21 prevents also in an effective manner the danger of compressing the hollow member during a spotlike load on the ski.

The web 21' in FIG. 9 has also a comparable effect.

FIG. 10 illustrates a comparable embodiment of the hollow member, wherein two webs 21'' are provided which terminate inside the hollow member, while the mass member 1 is divided into three parts, which are secured on a common flat belt 2''.

FIG. 11 illustrates a further embodiment of a hollow member 15, which has a solid center piece 22 in the part of the hollow member 15, in which the mass members 1 must no longer be moved. As is schematically illustrated in FIGS. 12 and 13, the solid center piece 22 has a recess 23 or 23', in which the flat belts 2 are guided.

The solid center piece 22 can in this embodiment of the hollow core 15 be moved into the hollow core and can be glued to same. On the other hand, however, it is also possible to move two parts of the hollow member 15 from both sides onto the solid center piece 22 and glue them to same.

In this embodiment of the hollow member, an increased stiffness is achieved by the provision of the solid cross section of the center part and also the shorter length of the then still remaining cavities of the hollow member.

Figure 15:
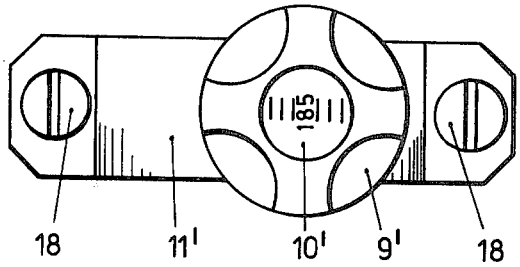

FIGS. 14 and 15 illustrate in a cross-sectional and a top view a different embodiment of the adjusting mechanism 3 which is shown in FIGS. 1 and 2. In this embodiment, the first drum 4 is connected to a bevel gear 6' or is constructed at its one front side as such a bevel gear. A second bevel gear 7' mates with the bevel gear 6', which second bevel gear 7' is arranged with the second drum 5' and the set wheel 9' on a common shaft. The rotary axes of the first drum 4 and of the second drum 5' are arranged perpendicularly with respect to one another and the set wheel 9', the second drum 5' and also the third flat belt 8', when it is wound on the second drum 5' or, however, is unwound from same, each rotate in a substantially horizontal plane.

As can clearly be recognized from FIG. 15, the set wheel 9' is thereby above the housing 11' of the adjusting mechanism 3. The set wheel 9' can therefore be rotated still more comfortably by hand or for example also with the ski pole.

To guide the third flat belt 8' from the second drum 5' to the first drum 4 a first guide roller 25 or a correspondingly stationary guide surface and a second guide roller 26 are provided. The second guide roller 26 is thereby held in a here only schematically indicated manner with the aid of a spring 27 in such a position, that the third flat belt 8' is always tensioned between its part which is wound on the second drum 5' and its part which is wound on the first drum 4. In this manner the clearance during winding and unwinding of the third flat belt 8' can be balanced in a particularly simple manner.

For feeding in the first and second flat belts 2 from the hollow member again guide pieces 12, 13 and 14 are provided, which are constructed similar to the guide pieces which are already shown in FIG. 3. As will be recognized from FIG. 14, the illustrated embodiment of the adjusting mechanism 3 has the further advantage that the mass member 1 which is provided in the front part of the ski can be adjusted farther toward the center of the ski when the adjusting mechanism 3 is mounted on the ski in front of the binding, than is the case in the embodiment shown in FIG. 3.

The set wheel 9' is provided with a light-permeable channel which is arranged below the window 10', which channel can be formed for example by a cylinder-shaped plexiglass piece, and ends in the direct vicinity of the third flat belt 8' which is wound on the first drum 4. Graduated indicia which is provided on the third flat belt 8' can therefore be read through the window 10', as this is shown in FIG. 15.

Just like in the first embodiment of the adjusting mechanism 3 which is shown in FIG. 3, the second embodiment which is shown in FIG. 14 is also arranged in a moistureproof housing 11'. A seal 24 seals off the opening for the set wheel 9' which extends through a wall of the housing 11'. The housing 11' is sealingly mounted with the aid of screws 18 on the ski member.

Figure 16:
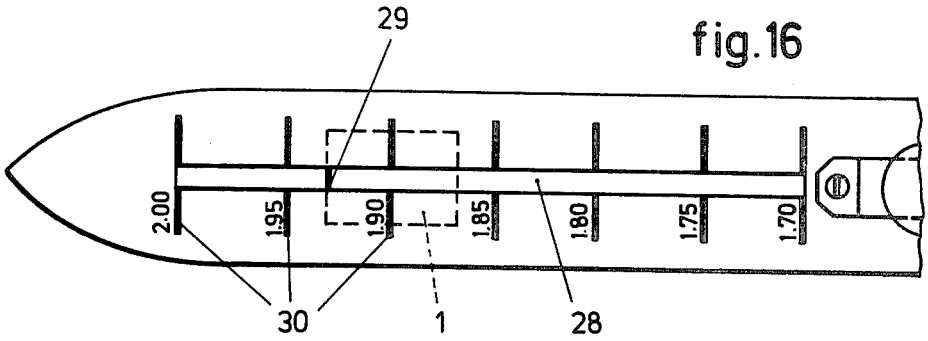
FIG. 16 is a top view of the front part of the ski with a special indication for the respective position of the mass member.

FIG. 16 illustrates schematically the front portion of a ski, which has on its upper side a light-permeable strip 28 which extends over the adjusting range of the mass member 1 and extends to the guideway of the mass members or the upper side of the hollow member 15 and thus makes visible a marking 29 which is provided on the mass member 1 or the flat belt 2. In the area of the strip 28 on the upper side of the ski there is provided a graduated indicia 30, which permits a reading of the respective position of the marking 29 on the mass 1 to indicate the position of the mass member 1.

Although particular preferred embodiments of the invention have been disclosed in detail for illustrative purposes, it will be recognized that variations or modifications of the disclosed apparatus, including the rearrangement of parts, lie within the scope of the present invention.

The embodiments of the invention in which an exclusive property or privilege is claimed are defined as follows:

1. In an adjusting mechanism for a ski, with which one or several mass members are movable within the ski member along its longitudinal axis and can be secured within the adjusting range at any desired point, with a set wheel which can be adjusted manually and with belts which are connected to the mass members and which are moved by the set wheel, the improvement comprising wherein the belts are flat belts which are stressed for pull and compression, the free ends of which flat belts are connected to each one of the mass members, and wherein at least one first drum is connected to the set wheel, onto the circumference and from the circumference of which the flat belts can be wound and unwound.

2. The improved mechanism according to claim 1, wherein two first drums are provided, onto the circumference of which or from the circumference of which each one of the flat belts can be wound and unwound.

3. The improved mechanism according to claim 2, wherein a separate set wheel is connected to each one of the first drums for the individual adjustment of the associated mass member.

4. The improved mechanism according to claim 1, wherein both flat belts can be wound and unwound superposed onto or from only one first drum.

5. The improved mechanism according to claim 1, wherein four flat belts and four mass members are provided, and wherein each two of the flat belts can be wound and unwound superposed on or from the two first drums, in order to move each two of the four mass members parallel to one another.

6. The improved mechanism according to claim 1, wherein next to the first drum there is arranged a second drum, onto or from the circumference a third flat belt can be wound and unwound, wherein the first flat belts can be wound and unwound overlappingly together with same onto the first drum, and both drums are coupled with one another for their common rotation.

7. The improved mechanism according to claim 6, wherein each one gear is provided on the shafts of the drums, which gears mate with one another.

8. The improved mechanism according to claim 7, wherein between the gears a transmission ratio is selected, which reduces the controlling forces which are produced by the set wheel.

9. The improved mechanism according to claim 8, wherein the diameters of the drums are different and are adjusted to the transmission ratio of the gears in order to wind or unwind onto or from the first drum approximately the same length of the third flat belt, as is being wound or unwound onto or from the second drum, whereby, however, a certain clearance exists.

10. The improved mechanism according to claim 9, wherein the clearance is balanced by a spiral spring, which initially tensions one of the drums with respect to its associated gear, which permits a rotation with respect to the drum, which rotation corresponds with the clearance.

11. The improved mechanism according to claim 7, wherein the drums and gears are arranged in a housing, which is sealingly mounted on the ski member.

12. The improved mechanism according to claim 11, wherein guide pieces are provided for the bent-free feeding of the flat belts from the housing into the hollow member.

13. The improved mechanism according to claim 6, wherein the set wheel is positioned on the shaft of the second drum.

14. The improved mechanism according to claim 6, wherein the first and second drums are arranged axially parallel to one another.

15. The improved mechanism according to claim 6, wherein the first and second drums are arranged with axes which are positioned perpendicularly with respect to one another, wherein the drums are coupled through a bevel toothing or a worm drive and wherein at least one guide roller is provided for guiding the third flat belt from the second drum to the first drum.

16. The improved mechanism according to claim 10, including a clearance balancing spring which holds the guide roller in a position which tensions the third flat belt.

17. The improved mechanism according to claim 6, wherein the third flat belt is provided with a graduated indicia, which can be read through a window.

18. The improved mechanism according to claim 1, wherein the flat belts are manufactured of steel.

19. The improved mechanism according to claim 1, wherein the flat belts are slightly arced in transverse direction.

20. The improved mechanism according to claim 1, wherein the flat belts are guided in a flat hollow member, which extends along the longitudinal axis of the ski, in which hollow member the mass members are also movably guided.

21. The improved mechanism according to claim 15, wherein the hollow member is divided by at least one crossbar which extends in its longitudinal direction.

22. The improved mechanism according to claim 15, wherein the inside of the hollow member is accessible at the rear edge of the ski for installation and service and wherein a cap piece can be screwed to the rear edge of the ski for the moistureproof closing off of the hollow member.

23. The improved mechanism according to claim 22, wherein the hollow member is manufactured separately of a fiber-reinforced plastic and is subjected during the manufacture of the ski member, already inserted in same, together with same to individual manufacturing steps, as for example to the hardening, and a core piece is provided in the hollow member, which can be removed through the opening at the rear edge of the ski from same.

24. The improved mechanism according to claim 22, wherein the hollow member has in its center part, in relationship to the longitudinal direction, a full center piece, in which a guide slot alone is provided for the flat belts.

25. The improved mechanism according to claim 24, wherein the center piece is moved into the hollow member.

26. The improved mechanism according to claim 1, wherein at least in the front part of the ski above the adjusting area of the mass members is provided a light-permeable strip, which makes visible a marking which is mounted on the mass member and/or the flat belts, and a graduated indicia, which makes it possible to read the respective position of the marking.

* * * * *